United States Patent [19]

Bolin

[11] Patent Number: 4,671,361

[45] **Date of Patent: * Jun. 9, 1987**

[54] METHOD AND APPARATUS FOR HYDRAULICALLY RELEASING FROM A GRAVEL SCREEN

[75] Inventor: Michael L. Bolin, Knoxville, Tenn.

[73] Assignee: Halliburton Company, Duncan, Okla.

[ * ] Notice: The portion of the term of this patent subsequent to Jan. 6, 2004 has been disclaimed.

[21] Appl. No.: 756,892

[22] Filed: Jul. 19, 1985

[51] Int. Cl.[4] ..... E21B 43/10

[52] U.S. Cl. ..... 166/377; 166/51; 166/144

[58] Field of Search ..... 166/51, 126, 128, 129, 166/131, 138, 144, 150, 152, 377, 386

[56] References Cited

U.S. PATENT DOCUMENTS

| | | | |
|---|---|---|---|
| 3,627,046 | 12/1971 | Miller | 166/278 |
| 3,997,006 | 12/1976 | Wetzel | 166/377 |
| 4,049,055 | 9/1977 | Brown | 166/278 |
| 4,175,778 | 11/1979 | Nunez et al. . | |
| 4,418,754 | 12/1983 | Steff | 166/278 |
| 4,440,218 | 4/1984 | Farley | 166/51 |
| 4,474,239 | 10/1984 | Colomb et al. | 166/278 |
| 4,519,451 | 5/1985 | Gray et al. | 166/386 |
| 4,522,264 | 6/1985 | McNeer | 166/278 |
| 4,570,714 | 2/1986 | Turner et al. | 166/377 |

*Primary Examiner*—James A. Leppink
*Assistant Examiner*—William P. Neuder
*Attorney, Agent, or Firm*—Joseph A. Walkowski

[57] ABSTRACT

The present invention comprises a method and apparatus especially suitable for hydraulically releasing from a screen on a circulation-type gravel pack job. The releasing tool of the present invention comprises a tubular case by which the tool is secured to a gravel packer thereabove, and a gravel screen is secured thereto therebelow, the case having disposed within a collet sleeve assembly shouldering on the top of the case and including a plurality of collets extending downwardly into the case, the collets being radially outwardly biased into engagement with the case by the lower end of a releasing mandrel disposed within the collet sleeve. A ball seat at the top of an axial bore extending through the releasing mandrel permits the seating of a ball and downward movement of the releasing mandrel inside the collet sleeve, removing the outward bias against the collets and permitting withdrawal of the collet sleeve and releasing mandrel from the case and attached screen therebelow. Reversing ports may be incorporated in the wall of the upper collet sleeve, to be uncovered when release mandrel moves downward therein, to positively identify release from the screen and to permit displacement of gravel slurry from the tubing string and annulus above the releasing tool with a clean fluid prior to removal of the string from the well bore. A reversing boot may be employed about collet sleeve proximate reversing ports therein, to prevent back flow in the tool.

The general method employing the aforesaid tool briefly comprises transmitting pressure down to the ball seat in the releasing tool with a ball disposed above the seat; moving the releasing mandrel down, thus disengaging the collets from the tool case and pulling the collet sleeve and releasing mandrel out of the tool case, leaving the gravel screen and attached tool case in the wellbore.

16 Claims, 8 Drawing Figures

METHOD AND APPARATUS FOR HYDRAULICALLY RELEASING FROM A GRAVEL SCREEN

BACKGROUND OF THE INVENTION

This invention relates to a tool for use in gravel packing wells. More specifically, this invention relates to a tool for the retention and release of a gravel pack screen assembly when gravel packing wells.

In wells in geological formations where the production of sand from the formation along with the liquids and gases being produced therefrom is a problem, it is well known in the art to install a screen in the production tubing and pack gravel around the screen to prevent the sand from the formation flowing into the production tubing. In such an arrangement, a gravel pack screen assembly is run into the formation on a string of tubing to the desired location and gravel, typically coarse sand mixed in a gelled liquid, is pumped down to the exterior of the gravel pack screen assembly to fill the area between the screen assembly and the formation. After a sufficient amount of gravel has been pumped down to the exterior of the gravel pack screen assembly to completely fill the area between the screen assembly and the formation, the screen assembly is released from the tubing string and the tubing removed from the well with production tubing subsequently being installed in the well.

Typical prior art tools used to retain and subsequently release gravel pack screen assemblies have required the rotation of the tubing string to release the tool and tubing attached thereto from the gravel pack screen assembly. If rotation of the tubing is required to release the tool and tubing string from the gravel pack screen assembly, this means that equipment capable of rotating the tubing string must be provided at the well.

While hydraulic releasing tools, which do not require rotation of the tubing string to operate, have been employed on squeeze-type and wash-down gravel packing jobs, prior art circulation-type gravel packing jobs, based on retrievable gravel packers, require rotation of the tubing string to release from the packed screen at the end of the job.

SUMMARY OF THE INVENTION

In contrast to the prior art, the present invention comprises a method and apparatus especially suitable for hydraulically releasing from a screen on a circulation-type gravel pack job. The releasing tool of the present invention comprises a tubular case by which the tool is secured to a gravel packer thereabove, and a gravel screen is secured thereto therebelow, the case having disposed within a collet sleeve assembly shouldering on the top of the case and including a plurality of collets extending downwardly into the case, the collets being radially outwardly biased into engagement with the case by the lower end of a releasing mandrel disposed within the collet sleeve. A ball seat at the top of an axial bore extending through the releasing mandrel permits the seating of a ball and downward movement of the releasing mandrel inside the collet sleeve, removing the outward bias against the collets and permitting withdrawal of the collet sleeve and releasing mandrel from the case and attached screen therebelow. Reversing ports may be incorporated in the wall of the upper collet sleeve, to be uncovered when release mandrel moves downward therein, to positively identify release from the screen and to permit displacement of gravel slurry from the tubing string and annulus above the releasing tool with a clean fluid prior to removal of the string from the well bore. A reversing boot may be employed about collet sleeve proximate reversing ports therein, to prevent back flow in the tool.

The general method employing the aforesaid tool briefly comprises transmitting pressure down to the ball seat in the releasing tool with a ball disposed above the seat; moving the releasing mandrel down, thus disengaging the collets from the tool case and pulling the collet sleeve and releasing mandrel out of the tool case, leaving the gravel screen and attached tool case in the wellbore.

BRIEF DESCRIPTION OF THE DRAWINGS

The present invention will be more readily understood by one of ordinary skill in the art through a review of the following detailed description of the preferred embodiment, taken in conjunction with the accompanying drawings, wherein.

DETAILED DESCRIPTION OF A FIRST PREFERRED EMBODIMENT

Figure 2A:
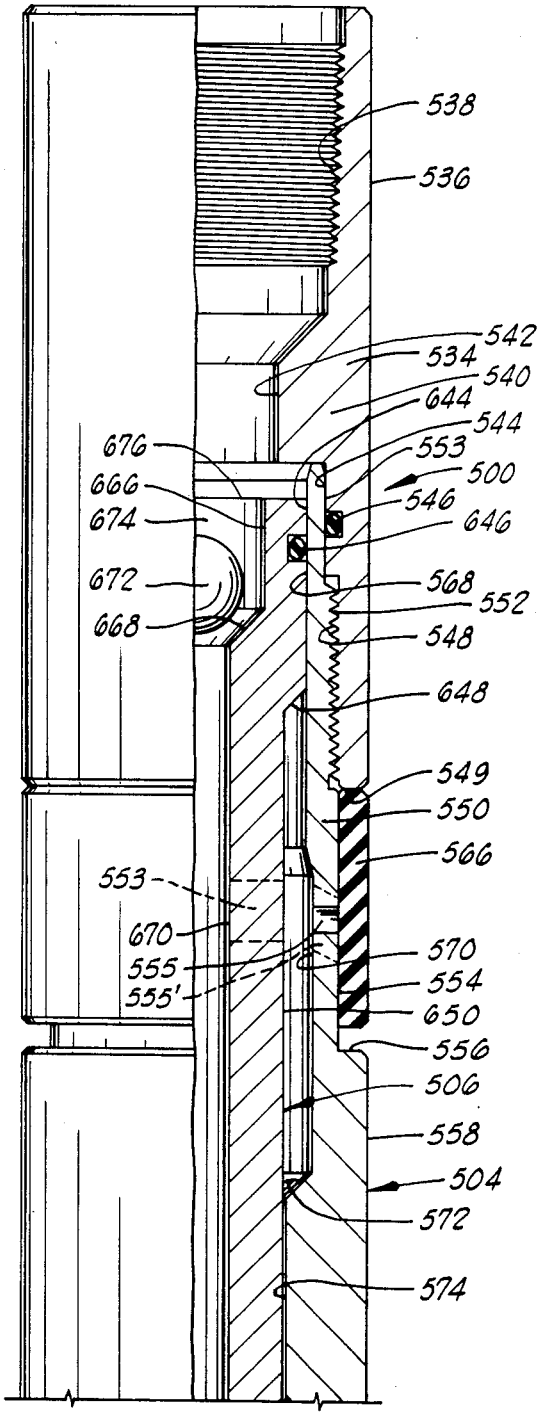
FIGS. 2A–2D comprise a detailed half-sectional elevation of a first preferred embodiment of the hydraulic releasing tool of the present invention.
Figure 2B:
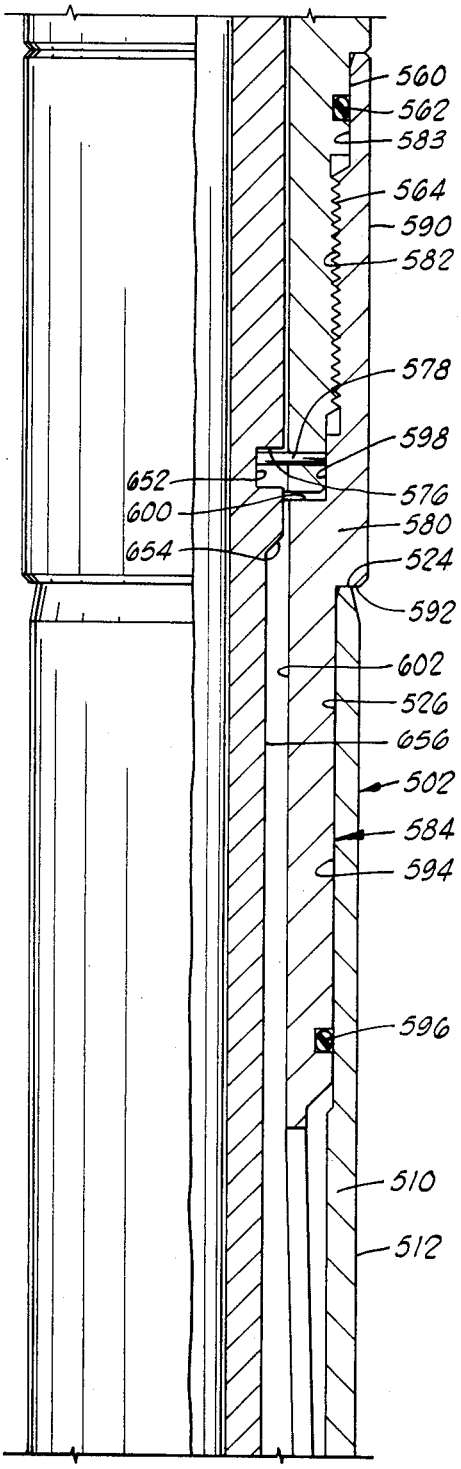
Figure 2C:
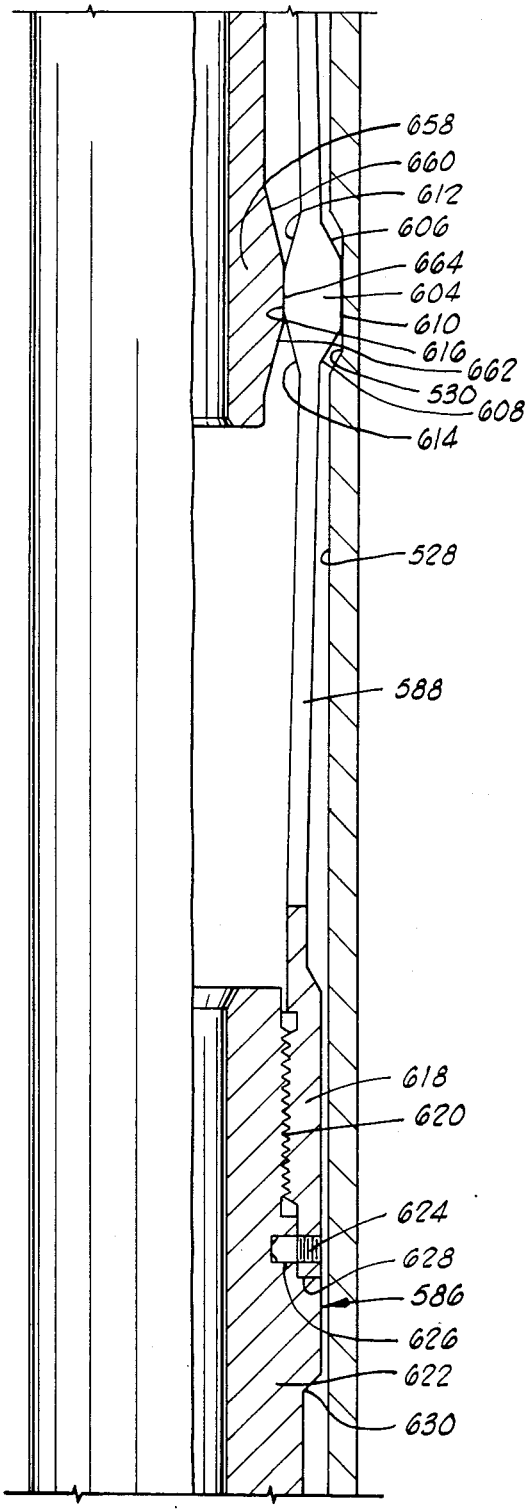
Figure 2D:
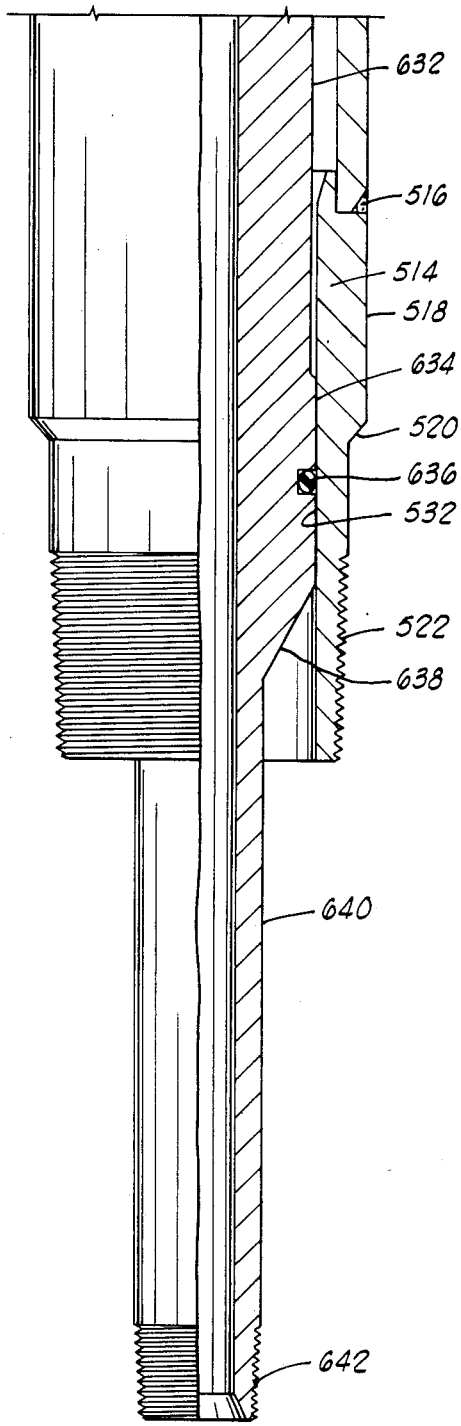

Referring to FIGS. 2A–2D of the drawings, the first preferred embodiment of the hydraulic releasing tool 500 of the present invention includes tool case 502, collet sleeve 504 and releasing mandrel 506. Tool case 502 includes a generally tubular hookup nipple 510 having a cylindrical exterior 512, leading to a lower adapter 514 welded thereto at 516, and having a cylindrical exterior 518 leading to chamfered surface 520 and threads 522. The top of tool case nipple 510 is defined by radially flat annular shoulder 524, below which upper collet sleeve seal bore 526 extends on the case interior, collet bore 528 extending downward to the top of lower adapter 514 and having annular collet recess 530 cut therein. The interior of lower adapter 514 comprises lower collet sleeve seal bore 532.

Collet sleeve 504, the lower end of which is disposed in tool case 502, includes upper adapter 534 having cylindrical exterior surface 536 and threaded upper interior bore 538 necking down at annular shoulder 540 to define lower smooth bore 542, below which seal bore 544 carries O-ring 546 above threaded exit bore 548, terminating at bottom rim 549.

Upper adapter 534 is secured to ported sleeve 550 at threaded surface 552, seal surface 557 at the top of sleeve 550 sealing against O-ring 546. Below surface 552, annular reversing boot surface 554 extends to annular shoulder 556, extending radially outwardly to cylindrical sleeve outer surface 558, which terminates at lower seal surface 560 carrying O-ring 562, below which threaded trailing surface 564 extends to the bottom of ported sleeve 550. Elastomeric annular reversing boot 566 is disposed about check sleeve surface 554 over reversing ports 555 and maintained thereon between the bottom ring 549 of upper adapter 534 and annular shoulder 556. The interior of ported sleeve 550 includes mandrel seal bore 568 leading to annular reversing recess 570 therebelow, which in turn terminates at beveled shoulder 572 extending inwardly to mandrel bore 574. Radial shear pin apertures 576 extend through the wall of ported sleeve 550 proximate the bottom thereof, shear pins 578 extending inwardly therefrom.

Collet body 580 is secured to ported sleeve 550 by threaded bore 582, seal bore 583 thereabove sealing with O-ring 562, collet body comprising upper collet ring 584, lower collet ring 586, and a plurality of longitudinally extending, circumferentially spaced collet fingers 588 extending therebetween. The upper exterior of upper collet ring 584 comprises cylindrical surface 590, below which annular bearing surface 592 rests on annular shoulder 524 at the top of tool case housing 510. Below bearing surface 592, seal surface 594 carrying O-ring 596 effected a seal against upper sleeve seal bore 526. The interior of upper collet ring 584 below threaded bore 582 comprises shear pin support bore 598 leading to radially flat annular surface 600, from which smooth bore 602 extends downward to collet fingers 588.

Each collet finger 588 includes a collet 604 disposed proximate the midpoint thereof, collets 604 each including tapered upper and lower radially outer edges 606 and 608 bracketing a vertically extending intermediate case bearing edge 610, and tapered upper and lower radially inner edges 612 and 614 bracketing on intermediate mandrel bearing edge 616.

Lower collet ring 586 comprises an assembly of a collar 618 at the lower extent of collets 588 secured at threaded junction 620 to wash pipe adapter 622, and prevented from backing off therefrom by set screws 624. The exterior of washpipe adapter 622 includes set screw recess 626 below which the bottom of collar 618 rests on annular shoulder 628, the lower end of which includes chamfered edge 630 leading to recessed exterior surface 632. Nipple seal surface 634, carrying O-ring 636, bears against lower sleeve seal bore 532 of lower adapter 514, frusto-conical trailing surface 638 leading therebelow to cylindrical washpipe extension 640, ending with threaded surface 642.

Returning to the top of hydraulic releasing tool 500, releasing mandrel 506 is of generally tubular configuration, the exterior thereof being defined by collet sleeve seal surface 644 carrying O-ring 646, necking inward via chamfered edge 648 to cylindrical shear pin bore 650 having annular shear pin recess 652 cut therein, the exterior further necking down therebelow at tapered edge 654 to extension surface 656 carrying tapered annular collet shoulder 658 at the bottom thereof, shoulder including upper and lower oblique surfaces 660 and 662 bracketing cylindrical intermediate collet bearing surface 664 therebetween. The interior of releasing mandrel 506 includes check ball bore wall 666 ending at a frusto-conical ball check seat 668 which necks down to fluid return bore 670, extending to the bottom of mandrel 506. Check ball 672 is maintained in check ball bore 674 by roll pin 676 thereabove.

Referring again to FIGS. 2A–2D, and particularly 2A, it will be seen how the preferred embodiment 500 of the invention may be modified by the deletion of reversing boot 566, and the possible inclusion of a second set of ports 553 in releasing mandrel 506 with enlargement of ports 555 to the dimensions shown in broken lines, designated as 555'. In addition, check ball 672 and roll pin 676 may be deleted from the preferred embodiment. The utility of such modifications will be explained at the end of the following description of the operation of the preferred embodiment.

OPERATION OF THE PREFERRED EMBODIMENT

Figure 1A:
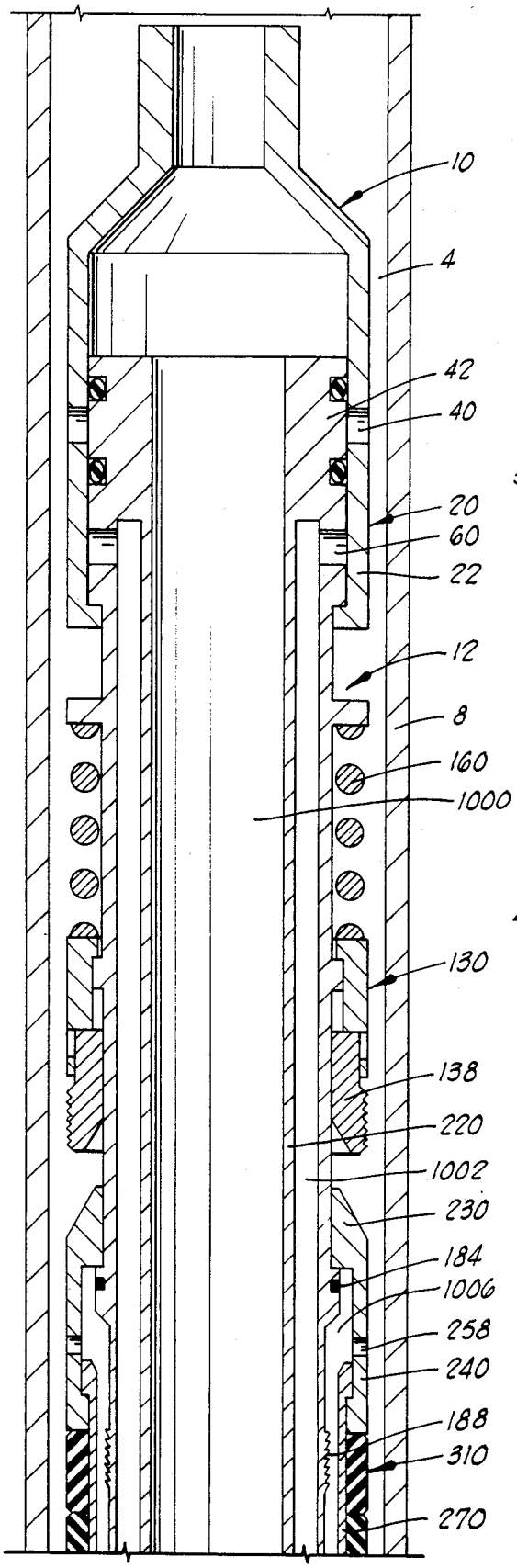
FIGS. 1A–1D comprise a schematic full sectional vertical elevation of the hydraulic releasing tool of the present invention suspended from a retrievable gravel packer at the end of a tubing string, and having a gravel screen suspended from the bottom thereof.
Figure 1B:
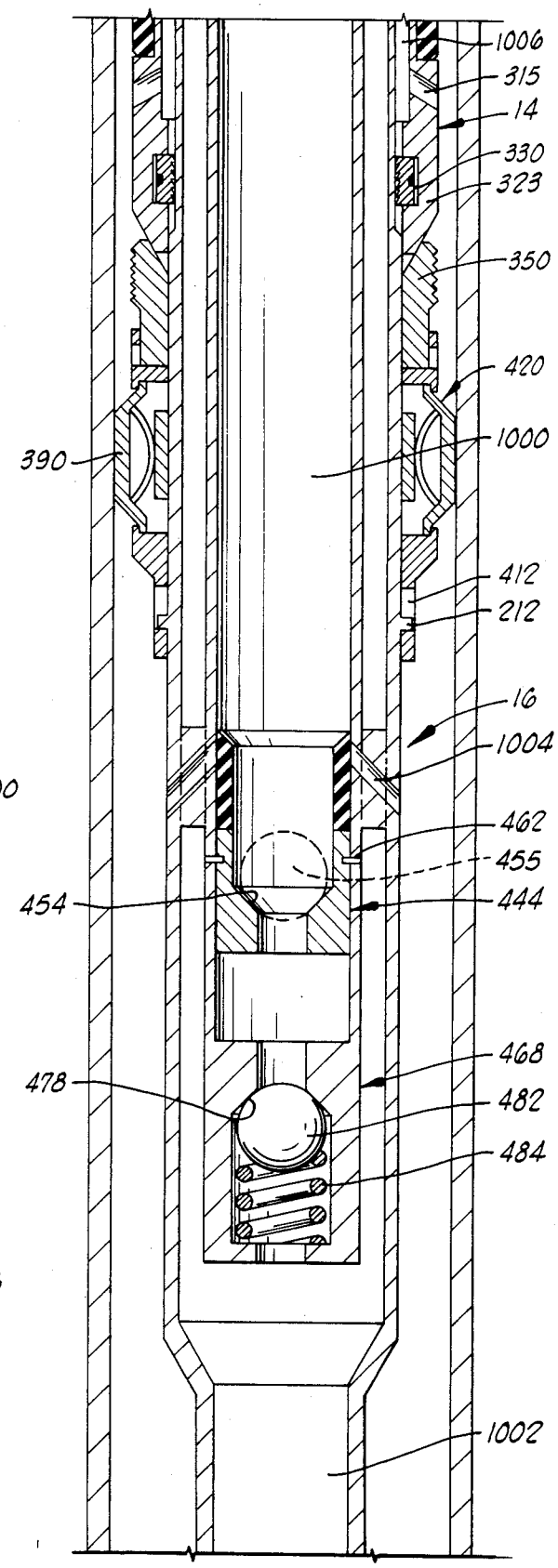
Figure 1C:
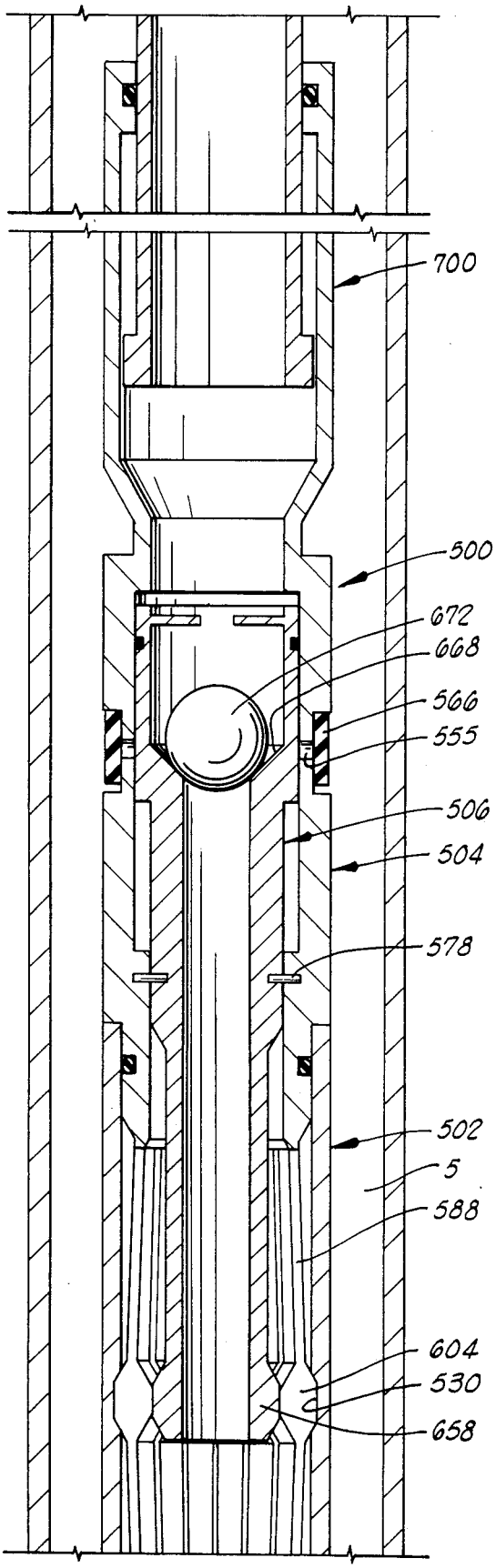
Figure 1D:
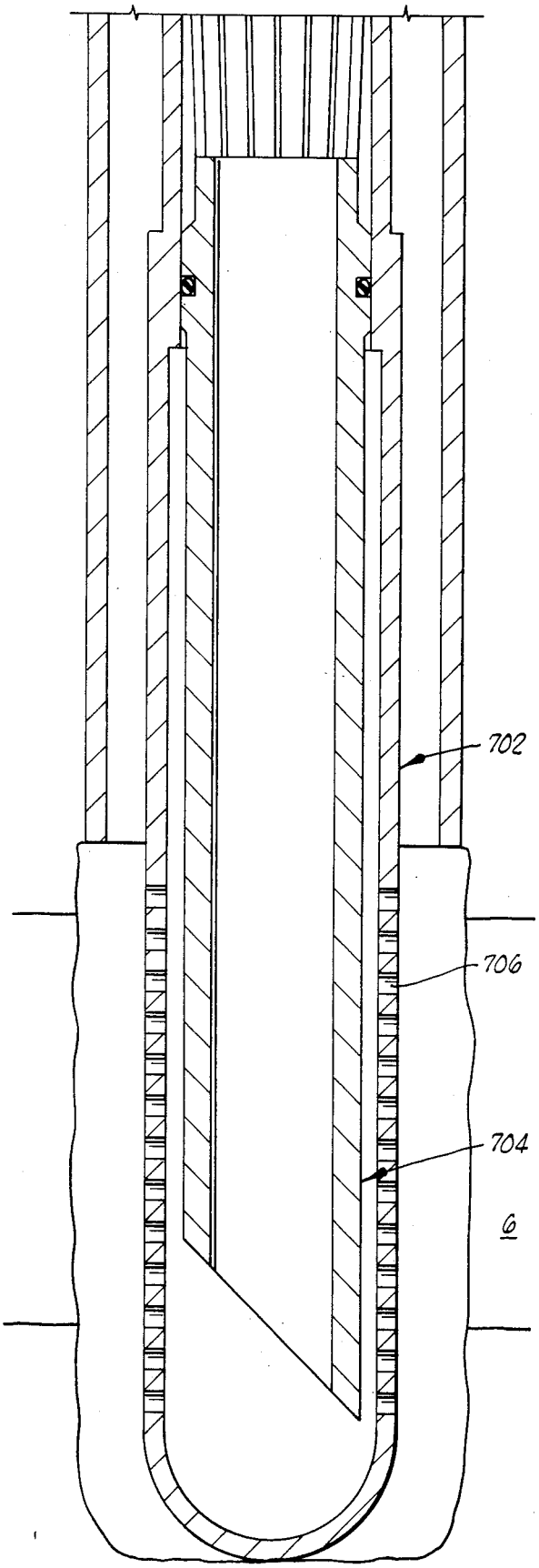

Referring to FIGS. 1A–1D and 2A–2D, a gravel packer 10 suspended from a tubing string (not shown) is schematically depicted in wellbore casing or liner 8, an hydraulic releasing tool 500 of the present invention being disposed below gravel packer 10 through slip joint 700 and a gravel screen 702 suspended from hydraulic releasing tool 500 below blank pipe. Gravel screens and slip joints are well known in the art, and gravel packer 10 may be as more fully described in co-pending U.S. patent application Ser. Nos. 757,040, 757,115 or 757,036, all filed on even date herewith and assigned to Halliburton Company and incorporated herein by reference. A washpipe or tailpipe 704 is suspended from hydraulic releasing tool 500 and extends into screen 702, which extends across producing formation 6. As the tubing string is run into the wellbore, fluid can move around packer element means 310 via bypass passage 1006, and the tubing string is filled through circulation passages 1004 and intake passage 1000, due to inward deflection of sleeve 446 in response to the wellbore/tubing string pressure differential.

After running the tubing string into the wellbore, the bottom of the wellbore is tagged with gravel screen 702 and slip joint 700 is compressed. The string is then picked up to extend the slip joint 700 while leaving the screen 702 on bottom.

Gravel packer 10 is then set by application of right-hand rotation through mandrel assembly 12, which moves J-slot lugs 212 to positions above the open bottoms of J-slots 412 from which they were removed when the tubing string was picked up. The tubing string is then set down, which sets lower slips 350 against lower slip wedge collar 323 (FIG. 1B) through movement of mandrel assembly 12 with respect to housing assembly 14, the latter's movement being restricted by drag blocks 390. After lower slips 350 set against casing 8, continued downward travel of mandrel assembly 12 closes bypass passage 1006 (FIG. 1A) by bringing seal 184 against packer saddle 270, after which upper slip assembly 130, biased by spring 160, contacts upper slip wedge collar 230 and forces it and upper bypass case downward, compressing packer element means 310 against casing 8 after which upper slips 138 contact and set against casing 8. The downward travel of mandrel means assembly 12 results in ratchet dogs 330 engaging ratchet teeth 188, locking gravel packer 10 in a set mode, spring 160 aiding in maintaining it therein. The packer is then pulled upward by the tubing string to test the ratchet engagement and upper slips, and the annulus 4 between the tubing string and casing 8 is pressured up to test the seal of packer element means 310 against casing 8.

Gravel packer 10 may then be released from gravel screen 702 via hydraulic releasing tool 500, if desired. To effect release the tubing string is picked up to pull a specified force, for example, 1000 pounds, against the set gravel packer 10. Tubing pressure is then applied through intake passage 1000 of gravel packer 10, past ball 482 which is biased downward against spring 484, through slip joint 700 to seat ball 672 against seat 668 in hydraulic release tool 500. Pressure is continued until shear pins 578 shear, and releasing mandrel 506 moves downward inside collet sleeve 504, releasing collets 588 from the outward bias of annular shoulder 658 at the bottom of releasing mandrel 506, and uncovering reversing ports 555, which results in a perceptable pressure drop at the surface. Tubing pressure is then relieved, and weight set down on the gravel packer 10. This will align crossover ports 40 with crossover apertures 60 in crossover assembly 20; pressure is then applied to annulus 4, which will establish reverse circulation if screen release has been effected, through crossover assembly 20, return passage 1002, through slip joint 700, into hydraulic releasing tool 500, out reversing ports 555 past reversing boot 566, up the annulus 5 below gravel packer 10, into gravel packer 10 through circulation passages 1004 past sleeve 446 and up to the surface through intake passage 1000 and the tubing string.

Alternatively, screen 702 may be released via pressuring annulus 4 after setting down to open crossover assembly 20, which will be transmitted to hydraulic releasing tool 500 through the reverse circulation path described in the preceding paragraph, forcing releasing mandrel 506 downward.

To gravel pack, a ball 455 is then dropped or circulated down the tubing string through intake passage 1000 to ball seat 454 in check valve assembly 444. Pressure is then applied to shear pins 462, which when sheared permit check valve assembly 444 to move downward, uncovering circulation passages 1004 and establishing circulation through passages 1004, into annulus 5, down to gravel screen 702, through the apertures 706 therein, up washpipe 704, through hydraulic releasing tool 500 past unseated ball 672, through slip joint 700 and into return passage 1002, out of crossover assembly 20 through apertures 60 and ports 40, and up annulus 4 to the surface.

A fluid injection rate is then established by pulling up on the tubing string to close crossover assembly 20, and pressuring up the tubing until it is ascertained that fluid can be pumped into formation 6 at a desired rate and pressure. If not, the formation may have to be treated with acid to increase its permeability. If the injection rate is satisfactory, bypass passage 1006 can then be opened to "spot" the gravel-laden slurry to gravel packer 10 by pulling against the tubing string, applying pressure to annulus 4, rotating the tubing string to the right 12 to 16 turns to release ratchet dogs 330 from ratchet threads 188 and seal 184 from packer saddle 270, indicated by a relieving of the pressure in annulus 4. Slurry can then be spotted down to the gravel packer 10 without circulating fluid through screen 702, as fluid below packer element means 310 will be displaced upward into annulus 4 via bypass passage 1006 by the slurry traveling down the tubing string and into intake passage 1002. After slurry spotting, the tubing string is set down to close bypass passage 1006 and open crossover assembly 20. The slurry is circulated out passage 1004 and down to screen 702, the gravel being deposited outside screen 702 adjacent formation 6, fluid returns being taken up washpipe 704.

After the gravel pack is placed, the tubing string is again pulled against the set gravel packer 10 to close crossover assembly 20, and the pack slurry is squeezed into the formation and against screen 702 through intake passage 1000, circulation passages 1004 and lower annulus 5. If desired, the operator may alternate between circulating and squeezing several times to place more gravel and ensure the integrity of the pack. It should be noted that gravel packer 10 permits squeezing without subjecting the casing above packer element means 310 to squeeze pressure, an important feature in wells with old or otherwise deteriorated casing.

If the screen 702 has not previously been released, the tubing string is set down, and annulus 4 is pressurized, this pressure being transmitted through crossover assembly 20 and down return passage 1002 to hydraulic releasing tool 500 as previously described, to move releasing mandrel 506 downward.

Excess slurry can be reverse circulated out of the tubing string, gravel packer 10, annulus 5, by circulating clean fluid down annulus 4 to crossover assembly 20, down return passage 1002, through slip joint 700, out reversing ports 555 past boot 566, up annulus 5, into circulation passages 1004, and up intake passage 1000 to the surface through the tubing string.

The gravel pack can be retested if desired in the circulate and/or squeeze mode, and repacking done if necessary, in the same manner described above.

The gravel packer 10 may then be unset, by pulling the tubing string against gravel packer 10, applying pressure to the annulus, rotating the tubing string to the right to release the ratchets and open bypass passage 1006 (indicated by relief of annulus pressure). The tubing string is then pulled up to retract upper slips 138, unset packing element means 310, unset lower slips 350 and return lugs 212 back into J-slots 412. Gravel packer 10, with slip joint 700, collet sleeve 504 and releasing mandrel 506 may then be removed from the wellbore, leaving tool case 502 and screen 702 in place with the gravel packed about the latter. Subsequently, a tubing seal assembly on production tubing may be stabbed over tool case 502 (specifically hookup nipple 510) and formation 6 produced through screen 702.

It should be noted that the preferred embodiment of the hydraulic releasing tool of the present invention would be modified by the deletion of check ball 672 and roll pin 676 for use with the gravel packer disclosed in previously referred to U.S. patent application Ser. No. 757,036, previously incorporated herein by reference, due to the fact that the gravel packer disclosed therein possesses a releasable check ball retention assembly. This assembly will drop a check ball to the hydraulic releasing tool disposed therebelow in response to tubing pressure applied above a ball dropped to a ball seat in the gravel packer.

It should further be noted that the hydraulic releasing tool of the present invention may be employed in squeeze-type gravel packing with the aforementioned deletion of reversing boot 566, the inclusion of ports 553 in releasing mandrel 506, and preferably the enlargement of ports 555 to 555'. In such an application, a packer such as is disclosed in U.S. patent application Ser. No. 757,109, filed on even date herewith, assigned to Halliburton Company and hereby incorporated by reference or a packer such as a Halliburton Services CHAMP® III or RTTS packer, respectively, as described on pages 141 through 143 of the Halliburton Services Sales and Service Catalog Number 42 is hung from a tubing string, below which is a slip joint 700, the above-described modification to hydraulic releasing tool 500, and a gravel screen 702. The packer is set in the casing 8, and a formation injection rate established through ports 553 and 555'. A check ball 672 is then dropped from the surface through the tubing string, and pump pressure applied against ball 672 on seat 668, shifting releasing mandrel 506 downward inside collet sleeve 504 after pins 578 shear and releasing tool case 502 and screen 702 from the string components thereabove. The gravel slurry is then pumped down the tubing string, out ports 555′ into annulus 5 and around gravel screen 702. Alternatively, an injection rate can be established through ports 555′ after ball 672 is dropped. In such an instance, ports 553 in releasing mandrel 506 are not essential, as flow may then be established through ports 555′ above shifted releasing mandrel 506. When the gravel pack is in place, pressure is applied to compact it, and the string is removed from the well, collet sleeve 504 having disengaged tool case 502. Production tubing with a tubing seal assembly can then be stabbed over hookup nipple 510 at the top of tool case 502, and formation 6 produced.

Thus has been described a novel and unobvious method and apparatus for releasing from a gravel screen. It will be apparent to one of ordinary skill in the art that many additions, deletions and modifications to the preferred embodiment disclosed herein may be made without departing from the spirit and scope of the claimed invention.

I claim:

1. A hydraulic releasing tool for releasing a tool string from a gravel screen, comprising:

a tubular tool case having a cylindrical bore therein, said bore including recess means opening thereon, said tool case further including means for securing a gravel screen to said tool at the bottom thereof;

a collet sleeve having the lower end thereof disposed in said tool case, said collet sleeve including an adpater means above said tool case for securing said tool string thereto, sleeve means below said adapted means but above said tool case having ports extending through the wall thereof, collet body means slidably disposed in said tool case and including a plurality of circumferentially disposed longitudinally oriented resilient collet fingers extending between an upper collet ring and a lower collet ring, and collet means associated with said collet fingers proximate and extending into said recess means; and a tubular releasing mandrel slidably disposed in said collet sleeve and covering said ports, said releasing mandrel including a ball seat above and in communication with an axial bore on the interior thereof, and collet shoulder means on the lower exterior thereof, said collet shoulder means contacting and outwardly biasing said collet means into said recess means.

2. The apparatus of claim 1, further comprising shear pin means connecting said releasing mandrel and said collet sleeve.

3. The apparatus of claim 1, further comprising reversing boot means disposed about said collet sleeve and adapted to permit flow through said ports from the interior of said tool to the exterior thereof when pressure inside said tool exceeds that outside said tool.

4. The apparatus of claim 3, wherein said reversing boot means comprises a tubular elastomeric reversing boot.

5. The apparatus of claim 4, further including seal means disposed between the exterior of said releasing mandrel and the interior of said collet sleeve.

6. The apparatus of claim 1, further including a check ball disposed above said ball seat in said releasing mandrel.

7. The apparatus of claim 6, wherein said check ball is retained in said releasing mandrel by retaining means.

8. The apparatus of claim 1, further including means associated with said lower collet ring to secure a tailpipe thereto.

9. The apparatus of claim 1, further including ports extending between the interior and exterior of said releasing mandrel proximate said collet sleeve ports.

10. The apparatus of claim 9, further including seal means disposed between the exterior of said releasing mandrel and the interior of said collet sleeve.

11. A method of releasing a tool string from a gravel screen through a hydraulic releasing tool which includes:

a tubular tool case having a cylindrical bore therein, said bore including recess means opening thereon, said tool case further including means for securing a gravel screen to said tool at the bottom thereof;

a collet sleeve slidably disposed in said tool case, said collet sleeve including an adapted means for securing said tool string thereto, sleeve means therebelow having ports through the wall thereof, collet body means including a plurality of circumferentially disposed longitudinally oriented resilient collet fingers extending between an upper collet ring and a lower collet ring and collet means associated with said collet fingers proximate said recess means; and a tubular releasing mandrel slidably disposed in said collet sleeve, said releasing mandrel including a ball seat above and in communication with an axial bore on the interior thereof, a set of ports through the wall of said releasing mandrel below said ball seat proximate said collet sleeve ports, and collet shoulder means on the lower exterior thereof, said collet shoulder means contacting and outwardly biasing said collet means into said recess means comprising:

circulating fluid from the interior to the exterior of said tool through said mandrel and collet sleeve ports;

providing a check ball above said ball seat;

seating said check ball on said ball seat;

increasing pressure in said tool above said ball;

moving said releasing mandrel downward relative to said collet sleeve to a positon below said sleeve ports in response to said increased pressure;

removing said outward bias from said collets responsive to said downward movement of said releasing mandrel; and pulling said collet sleeve and said releasing mandrel out of said tool case on said tool string.

12. The method of claim 11, wherein said step of providing said check ball comprises ddropping said ball through said tool string to said ball seat prior to said pressure increase.

13. The method of claim 11, further including the step of shearing connecting means between said releasing mandrel and said collet sleeve responsive to said downward movement of said releasing mandrel.

14. A method of releasing a tool string from a gravel screen through a hydraulic releasing tool which includes:

a tubular tool case having a cylindrical bore therein, said bore including recess means opening thereon, said tool case further including means for securing a gravel screen to said tool at the bottom thereof;

a collet sleeve slidably disposed in said tool case, said collet sleeve including an adapter means for securing said tool string thereto, sleeve means therebelow having ports through the wall thereof, reversing boot means about said sleeve over said ports, collet body means including a plurality of circumferentially disposed longitudinally oriented resilient collet fingers extending between an upper collet ring and a lower collet ring and collet means associated with said collet fingers proximate said recess means; and a tubular releasing mandrel slidably disposed in said collet sleeve, said releasing mandrel including a ball seat above and in communication with an axial bore on the interior thereof, and collet shoulder means on the lower electric thereof, said collet shoulder means contacting and outwardly biasing said collet means into said recess means comprising:

providing a check ball above said ball seat;

seating said check ball on said ball seat;

increasing pressure in said tool above said ball;

moving said releasing mandrel downward relative to said collet sleeve to a position below said sleeve ports in response to said increased pressure;

removing said outward bias from said collets responsive to said downward movement of said releasing mandrel;

circulating fluid out of said tool past said reversing boot means; and pulling said collet sleeve and said releasing mandrel out of said tool case on said tool string.

15. The method of claim 14, wherein said step of providing said check ball comprises dropping said ball through said tool string to said ball seat prior to said pressure increase.

16. The method of claim 14, further including the step of shearing connecting means between said releasing mandrel and said collet sleeve responsive to said downward movement of said releasing mandrel.

* * * * *